United States Patent [19]

Deprez

[11] 3,985,012

[45] Oct. 12, 1976

[54] APPARATUS FOR FINISH ROLLING BEVEL PINIONS AND GEARS

[75] Inventor: Thomas A. Deprez, Rochester, N.Y.

[73] Assignee: The Gleason Works, Rochester, N.Y.

[22] Filed: July 28, 1975

[21] Appl. No.: 599,580

[52] U.S. Cl. ..... 72/101; 29/159.2

[51] Int. Cl.[2] ..... B21H 5/04

[58] Field of Search ..... 72/84, 101, 102; 29/159.2

[56] References Cited

UNITED STATES PATENTS

| | | | |
|---|---|---|---|
| 1,669,818 | 5/1928 | Gleason et al. | 72/84 |
| 3,605,467 | 9/1971 | White et al. | 72/84 |
| 3,635,062 | 1/1972 | Bregi et al. | 72/84 |
| 3,695,078 | 10/1972 | Bruinsma | 72/101 |

*Primary Examiner*—Lowell A. Larson
*Attorney, Agent, or Firm*—Ralph E. Harper

[57] ABSTRACT

An improved apparatus for roll forming tooth profiles on workpieces is provided with an adjusting means for adjusting the root angle of a workpiece. The adjusting means is designed to withstand the large forces generated with equipment of this type and can be used in combination with a separate means for pivotally moving a die and a workpiece relative to one another for bringing the die and the workpiece into and out of meshing engagement.

9 Claims, 5 Drawing Figures

APPARATUS FOR FINISH ROLLING BEVEL PINIONS AND GEARS

BACKGROUND AND BRIEF DESCRIPTION OF INVENTION

The present invention relates to an improved apparatus for roll finishing bevel gears, and more particularly, the invention provides for an adjusting means which offers extreme rigidity and precision for adjusting the root angle formed on a workpiece.

It is known in the art to roll finish bevel gear workpieces by applying a relatively high force between a die and a workpiece which are brought into meshing engagement. By feeding the die and the workpiece relative to each other it is possible to displace up to several thousandths of an inch of material on previously formed tooth profiles of the workpiece, and this serves to finish the tooth profiles to a final dimension and surface condition. Machines for carrying out this type of basic operation were disclosed as early as 1928 in Gleason et al U.S. Pat. No. 1,669,818 and have been disclosed in more recent years in U.S. Pat. Nos. 3,604,235 and 3,605,467, for example. As noted in the just-mentioned patent disclosures, apparatus for roll forming may typically include a first spindle means for carrying a gear member and a second spindle means for carrying a pinion member for meshing with the gear member during the rolling operation. Either the gear member or the pinion member may be a die for imparting final tooth profiles on a workpiece, and the other of the gear member or the pinion member comprises the workpiece itself.

Roll forming equipment requires relatively strong and rigid machine components because of the very high force loads required to displace material on a cold workpiece by the forceful engagement of a die with the workpiece. Thus, recent designs for such equipment have tended to contain and support the separate spindles of the machine so as to establish a rigid and fixed angular relationship between the pinion member and the gear member. Typically, this relationship has provided for a right angular disposition of the axes of rotation of the two members, and one axis may be offset from the other when a hypoid pinion or gear is being finished. In addition to fixed angular relationships, the early U.S. Pat. No. 1,669,818 provided for an adjustment of one spindle axis relative to the other for purposes of adjusting the root angle (also referred to as pressure angle) relationship between a meshing pinion and gear. However, the type of adjustment shown in U.S. No. 1,669,818 was not applied to a machine of the type contemplated herein in which both the die axis and the workpiece axis are movable about pivot points for effecting (a) initial engagement and final disengagement of the die and the workpiece and (b) relative feeding of the die and the workpiece during the rolling operation to obtain full depth of roll. In contrast, the root angle adjustment means of the present invention can be used with apparatus having such pivotal feed motions for its separate spindle axes, and makes provision for such pivotal feed motions without loss of a root angle setting. In addition, the root angle adjusting means of the present invention is positioned in close proximity to the working end of a spindle, and this establishes a fixed and precise stop limit which is not lost through bending moments of the spindle.

In accordance with a preferred embodiment of the present invention, a machine frame is designed to support the loads of a first spindle means carrying a gear member and a second spindle means carrying a pinion member so that the pinion and gear members can be brought into meshing engagement with one another for roll forming tooth profiles on whichever one of the members comprises a workpiece. The first spindle means is mounted for movement about a pivot axis which intersects the axis of rotation of the second spindle means to thereby provide for a pivotal feeding motion of the gear member relative to the pinion member. The second spindle means is likewise mounted for pivotal movement about an axis, and its movement functions to engage and disengage the pinion and gear at the beginning and end of each rolling operation for loading and unloading purposes. In the illustrated embodiment, the root angle adjusting means is operatively associated with the second spindle means, and thus, the adjusting means of this invention is designed and constructed to accommodate the pivotal motions of the second spindle means in its movements for engaging and disengaging a meshing pinion and gear.

In accordance with a specific embodiment of the invention the adjusting means includes a movable wedge-shaped member carried by the machine frame for establishing a stop surface against which a movable portion of the second spindle means (or its associated mounting means) can be moved when the second spindle means is pivoted to bring a pinion member into meshing engagement with a gear member. The adjusting means is positioned in close proximity to the working end of one of the movable spindles of the machines so that a precisely defined position for the stop surface can be maintained during a rolling operation. In addition, the invention provides for means for displacing the adjusting means completely out of its operative position to thereby remove the stop surface to provide clearance for gross movements of the second spindle means about its pivot axis. The displacing means is arranged to move the wedge-shaped member transversely from its adjusted position so that it can be returned to its operative position without loss of precision in whatever root angle setting has been set up for a particular job. Thus, gross movements of the second spindle means, as required for loading and unloading the apparatus, can be accomplished without disrupting a precision setting of the root angle relationship between a pinion and a gear.

These and other features and advantages of the root angle adjusting means of the present invention will become apparent in the more detailed discussion which follows, and in that discussion reference will be made to the accompanying drawings as briefly described below:

DETAILED DESCRIPTION OF INVENTION

Figure 1:
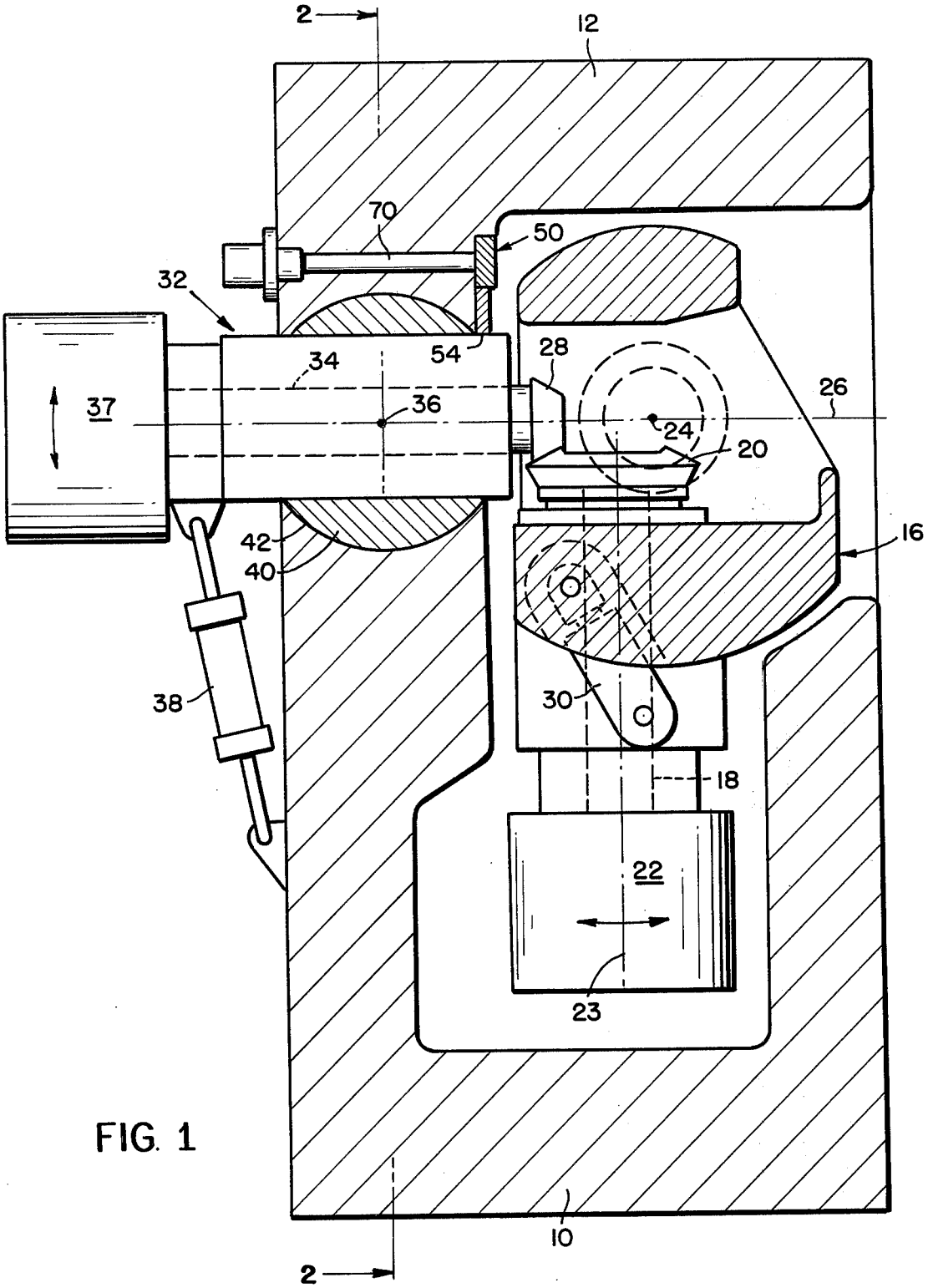
FIG. 1 is a side elevational view, partly in cross section, of the apparatus of the present invention.
Figure 2:
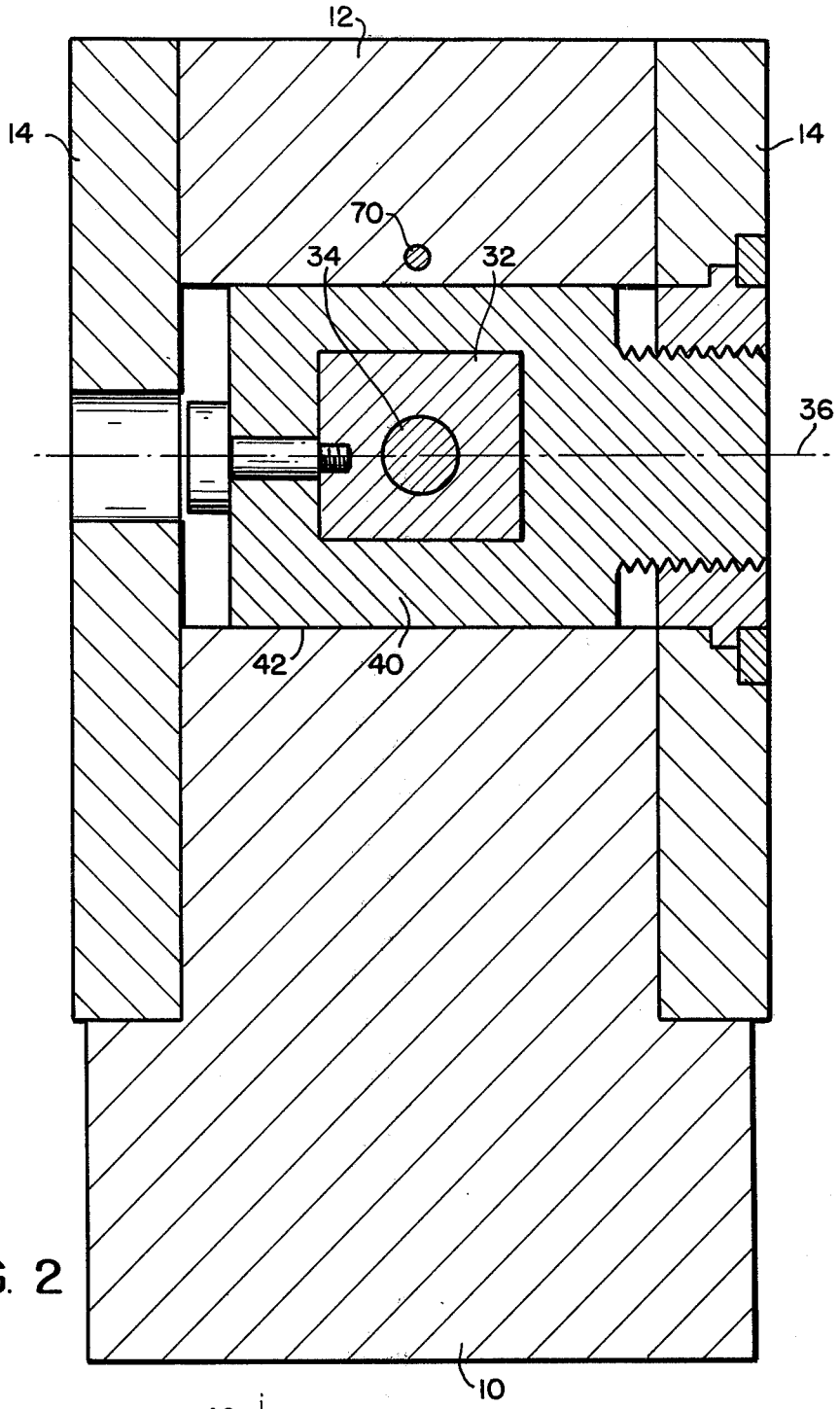
FIG. 2 is a front elevational view, partly in cross section, of the apparatus shown in FIG. 1 as seen on line 2—2 of FIG. 1.

FIGS. 1 and 2 depict a type of roll forming apparatus contemplated by the present invention. Such apparatus includes a machine frame having a base portion 10, a top portion 12, and side portions 14, all of which are secured together to form a rigid assembly for supporting other components of the apparatus. A first mounting means 16 functions to carry a first spindle means 18, and the first spindle means 18 includes a known form of chucking device for securing a gear member 20 in driving relationship therewith so that a motor means 22 can drive the gear member 20 about an axis 23. The first mounting means is suspended within the machine frame so as to be movable about a pivot axis at 24 which intersects an axis of rotation 26 associated with a pinion member 28. Known means are provided for journaling support structures of the first mounting means 16 in operative relationship to the machine frame so that the load of the first mounting means 16 is suspended for such pivotal movement within the machine frame. Hydraulic ram devices 30 are interconnected between a portion of the mounting means 16 and side portions 14 of the machine frame for applying controlled pivotal movements to the first mounting means 16 and its supported gear member 20. These movements, about the pivot axis at 24, function to feed the gear member 20 relative to the pinion member 28 during rolling engagement to thereby obtain full depth of roll during a finishing operation.

A second mounting means 32 serves to mount a second spindle means 34 for limited pivotal movement about a pivot axis at 36, and a motor means 37 is connected to the spindle means 34 for driving a supported pinion member 28 about axis 26. Suitable control devices can be provided for correlating the driving actions of the separate motor means 22 and 37. The pivot axis at 36 is parallel to the pivot axis 24 for the first mounting means. A hydraulic ram means 38 is interconnected between a portion of the second mounting means 32 and the machine frame for moving the second mounting means 32 about its pivot axis 36. These movements can be considered relatively gross movements which involve a complete disengagement or re-engagement of a pinion member 28 and a gear member 20 for purposes of unloading and loading the machine between its operating cycles. The second mounting means 32 is supported within a generally cylindrical support structure 40 having a bearing surface 42 for being received within a mating bearing surface formed in portions of the machine frame, to thereby provide for pivotal movement of the second mounting means and its contained second spindle means 34.

As illustrated, the first spindle means 18 is positioned within the machine frame in a generally vertical attitude, and the second spindle means 34 is positioned at substantially a right angle thereto in a generally horizontal attitude. The separate axes of rotation of the two spindle means may be offset (non-intersecting) relative to one another for rolling operations for hypoid pinions or gears. In other applications, the two axes of rotation can be disposed at right angles to one another in an intersecting relationship.

The various features which have been discussed so far in this detailed description of the invention are separately known in the art of roll forming of gears, although it is not known whether the particular combination of dual pivotal motions for separate spindles has been utilized in a single machine application. It is known, however, to provide for a pivotal feeding motion of a die and a workpiece which are in rolling engagement with each other (see, for example, U.S. Pat. No. 3,695,078).

Figure 3:
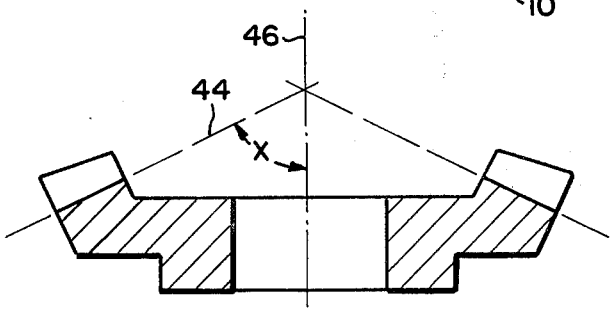
FIG. 3 is a depiction of a gear, showing the root angle for the gear.

The present invention is concerned with an improved adjusting means for adjusting the root angle of a workpiece which is to be roll finished, and the adjusting means is of a particular design for use in combination with a pivotally movable spindle for bringing a die and a workpiece into and out of meshing engagement. As shown in FIG. 3, the root angle of a gear comprises an angle $x$ between an element of a root cone 44 and an axis of rotation 46 of the gear. This same definition applies to pinion members. In either case, it is desirable to provide for a fine adjustment of root angle between a die and a workpiece in order to control displacement of material on the tooth surfaces being finished. Machines which do not provide for this type of precision adjustment are limited in what they can do in precision gear finishing applications because no root angle adjustment in tooth bearing pattern can be made between a given die and a workpiece. If the bearing pattern is not exactly right, a new die is required for such machines. As indicated in the preliminary discussion portion of this specification, it is known from U.S. Pat. No. 1,669,818 to provide for a root angle adjustment in gear rolling equipment, but the type of adjustment means shown in that patent is different from the one disclosed herein for use in combination with a pivoting spindle means and does not establish a rigid stop surface at the working end of a spindle.

FIG. 1 generally indicates a root angle adjusting means 50 as being carried in a portion of the machine frame which also contains the second mounting means 32. As shown in greater detail in FIGS. 4 and 5, the adjusting means 50 includes a movable wedge-shaped member 52 carried by the machine frame for establishing a stop surface 54 against which a portion of the second spindle means 34 (or its associated mounting means 32) can be moved when the second spindle means 34 is pivoted to bring the pinion member 28 into meshing engagement with the gear member 20 for a starting rolling operation. It can be seen that the stop surface 54 is established in close proximity to the working end (where work is being performed) of the spindle means 34, and this assures an unchanging relationship between the stop surface and the spindle during a rolling operation. The wedge-shaped member 52 is secured to a portion of the machine frame with fastening bolts 56. The bolts 56 pass through slots 58 formed through the wedge-shaped member 52, and the slots 58 permit a range of movement for the wedge-shaped member along it longitudinal axis. This movement can be effected by any known adjusting means, including manually operated screws or cams which apply a force to one end or the other of the wedge-shaped member 52. In the illustrated embodiment, cam elements 60 are provided at opposite ends of the wedge-shaped member, and these cam elements are arranged to be manually turned in such a way that one cam element can apply a force to an associated rod member 62 (for contacting one end of the wedge-shaped member) while the opposing cam element allows a retraction of its associated rod member 62 at the opposite end of the wedge-shaped member. Longitudinal movement of the wedge-shaped member 52 lowers or raises the position of the stop surface 54 through a follower plate assembly 64. The follower plate assembly is loosely mounted to a portion of the machine frame with bolts 66 passing through elongated slots 68 so as to permit free up and down movement of the follower plate. The follower plate 64 functions to accommodate very slight misalignments between the second spindle means (and its associated mounting means 32) and the wedge-shaped member 52.

Referring back to the general relationship shown in FIG. 1, it can be seen that pivotal movement of the second spindle means 34 is limited in the counterclockwise direction by the establishment of the stop surface 54 with the adjusting means 50. Thus, by moving the mounting means 32 and its contained spindle means 34 to a preset limit position against the stop surface 54, a preferred angular relatioinship is established between the spindle axes 23 and 26. This relationship defines the finished root angle which will be formed on a workpiece by a rolling engagement of the pinion member 28 with the gear member 20. After full depth of roll has been obtained (through the pivotal feeding motion of the first mounting means 16, as discussed above), it is necessary to move the pinion and die members out of engagement with each other so that a finished workpiece can be removed and a new workpiece loaded into the apparatus. The unloading sequence involves a first step of withdrawing the gear member 20 from its full depth engagement with the pinion member 28 (by actuating the hydraulic ram devices 30 to pivot the first spindle means and its associated mounting means in a counterclockwise direction about axis 24), followed by a second step of removing the pinion member 28 from any engagement at all with the gear member 20 (by actuating the ram device 38 to move the second spindle means and its associated mounting means in a counterclockwise direction about axis 36). It can be seen from the FIG. 1 relationships that the second step of unloading cannot be effected until the stop surface 54 is released or removed from its operative position for limiting movement of the second spindle means. Thus, it is necessary to provide, with the type of apparatus discussed herein, a separate means for displacing the wedge-shaped member 52 out of its operative position to thereby release the stop surface 54 from its adjusted position and to provide clearance for gross movements of the second spindle means in the counterclockwise direction.

Figure 4:
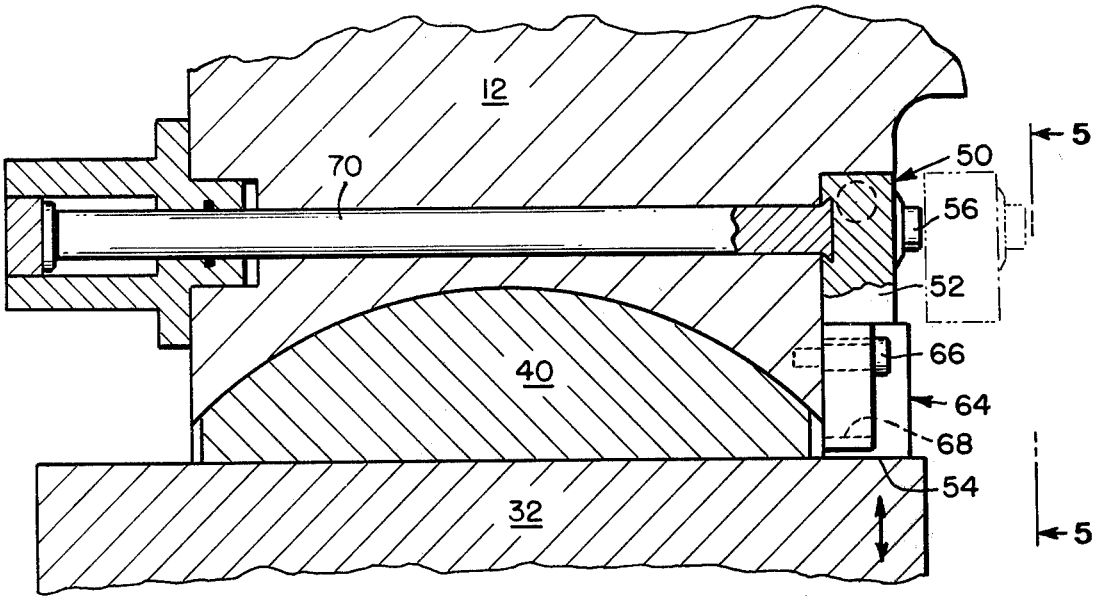
FIG. 4 is an enlarged view of a root angle adjusting means included in the overall view of FIG. 1.
Figure 5:
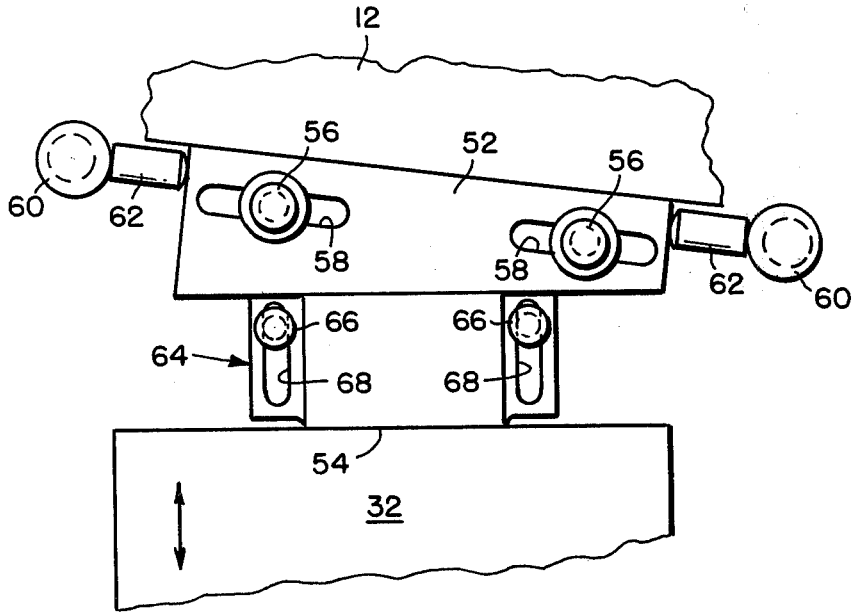
FIG. 5 is a view of the root angle adjusting means of FIG. 4, as seen in the same scale as FIG. 4 on line 5—5.

A preferred displacing means includes a shifting rod 70 for displacing the wedge-shaped member 52 to the dotted line position shown in FIG. 4. The shifting rod 70 is secured to the wedge-shaped member so as to advance and retract the wedge-shaped member with corresponding movements of the shifting rod, and movement of the shifting rod 70 is effected through known hydraulic controls which admit and release hydraulic fluid to and from a chamber 72 containing a piston element 74 attached to the shifting rod 70. It can be seen from the FIG. 4 illustrating that the follower plate assembly 64 is not displaced with such movements of the wedge-shaped member 52. This serves to eliminate any interference between the follower plate assembly and the wedge-shaped member during gross movements of the second spindle means, and the follower plate assembly 64 can simply follow such gross movements by virtue of its loosely mounted relationship to the machine frame and the provision of elongated slots 68 which are of a sufficient dimension to permit movement of the second spindle means 32 to a position which completely disengages the pinion and gear members 28 and 20.

After an unloading and loading operation has been completed, the second spindle means 34 is returned to a position which brings the pinion and gear members into partial meshing engagement (but not full depth engagement as determined by the feeding motion of the first spindle means), and the wedge-shaped member 52 is returned to its operative position to define a pre-set limit of travel for the second spindle means. Then the second spindle means is moved slightly into a limit position against the stop surface 54, and a new rolling operation can begin.

Having defined a specific embodiment of the root angle adjusting means of this invention, it can be appreciated that this type of adjusting means provides for a precision setting of a root angular relationship between a die and a workpiece and this precision relationship is not lost when the adjusting means is displaced from its operative position for loading and unloading the apparatus. In addition, it can be appreciated that the adjusting means can be associated with either spindle of a machine provided it is positioned near the working end of the spindle to prevent loss of setting due to bending of the spindle.

What is claimed is:

1. In apparatus for roll forming tooth profiles on a workpiece by bringing a die and a workpiece into rolling engagement with each other with sufficient force to displace material on said workpiece, said apparatus being of a type which includes a first spindle means for carrying a gear member and a second spindle means for carrying a pinion member for meshing with said gear member, with one of said gear member and said pinion member being a die for forming tooth profiles on a workpiece and the other of said gear member and said pinion member being the workpiece, the improvement comprising:

a machine frame, first mounting means for mounting said first spindle means within said machine frame so that said first spindle means can be moved about a pivot axis which intersects the axis of rotation of said second spindle means to thereby provide for a pivotal feed motion of the gear member relative to the pinion member, second mounting means for mounting said second spindle means in said machine frame for limited pivotal movement about an axis which is parallel to the pivot axis of said first spindle means, adjusting means operatively associated with said second spindle means for adjusting and fixing the angular relationship of said spindle means to thereby provide for a root angle adjustment of the tooth profiles being roll formed on a workpiece.

2. The improvement of claim 1 wherein said adjusting means includes:

a movable wedge-shaped member carried by said machine frame for establishing a stop surface against which a portion of said second spindle means can be moved when the second spindle means is pivoted to bring a pinion member into meshing engagement with a gear member, and displacing means for moving said wedge-shaped member out of its operative position to thereby release said stop surface from its adjusted position.

3. The improvement of claim 1 wherein said first spindle means is positioned within said machine frame with its axis of rotation in a generally vertical attitude, and wherein said second spindle means is positioned with its axis of rotation in a generally horizontal attitude.

4. The improvement of claim 1 wherein said second mounting means includes a housing for supporting said second spindle means, said housing having a generally cylindrical bearing surface for being received within a mating bearing surface formed in said machine frame to thereby provide for limited pivotal movement of the second spindle means.

5. The improvement of claim 1 and including separate motor means for rotating each of said spindles.

6. In apparatus for roll forming tooth profiles on a workpiece by bringing a die and a workpiece into rolling engagement with each other with sufficient force to displace material on said workpiece, said apparatus being of a type which includes a first spindle means for carrying a gear member and a second spindle means for carrying a pinion member which can be brought into meshing engagement with the gear member, with one of said gear member and said pinion member being a die for forming tooth profiles on a workpiece and the other of said gear member and said pinion member being the workpiece, the improvement comprising adjusting means operatively associated with one of said spindles for adjusting the root angle between the pinion member and said gear member, said adjusting means including:

a wedge-shaped member which is axially movable against a fixed portion of the apparatus to establish a stop surface against which a movable portion of the apparatus can be moved to thereby provide an adjustment of an associated spindle means about a pivot axis, and displacing means for moving said wedge-shaped member out of its operative position to thereby release said stop surface and to permit disengagement of a pinion member and a gear member.

7. The apparatus of claim 6 and including a follower plate assembly mounted between said wedge-shaped member and said second spindle means for accommodating very slight misalignments between said second spindle means and said wedge-shaped member.

8. The apparatus of claim 6 wherein said adjusting means is positioned near the working end of the spindle means with which it is associated.

9. In apparatus for roll forming tooth profiles on a workpiece by bringing a die and a workpiece into rolling engagement with each other with sufficient force to displace material on said workpiece, said apparatus being of a type which includes a first spindle means for carrying a gear member and a second spindle means for carrying a pinion member which can be brought into meshing engagement with the gear member, with one of said gear member and said pinion member being a die and the other of said members being the workpiece, the improvement comprising root angle adjusting means operatively associated with one of said spindle means for establishing an adjustable stop surface against which the associated spindle means can be positioned during a rolling operation, said root angle adjusting means being located near the working end of its associated spindle means so as to prevent loss of precision setting from bending moments of said spindle means.

* * * * *